US007380302B2

(12) United States Patent
Gilchrest, Jr. et al.

(10) Patent No.: US 7,380,302 B2
(45) **Date of Patent: *Jun. 3, 2008**

(54) BOLSTER SYSTEM AND METHOD

(75) Inventors: Edward Gilchrest, Jr., Oxford, CT (US); George E. Reihm, New Fairfield, CT (US)

(73) Assignee: Scott Technology LLC, Oxford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/616,266

(22) Filed: Dec. 26, 2006

(65) Prior Publication Data

US 2007/0101504 A1 May 10, 2007

Related U.S. Application Data

(63) Continuation of application No. 11/002,604, filed on Dec. 2, 2004, now Pat. No. 7,155,766.

(51) Int. Cl.
*A61G 7/057* (2006.01)

(52) U.S. Cl. ..... 5/732; 5/710; 5/713; 5/715

(58) Field of Classification Search ..... 5/193, 5/424–427, 710–713, 715, 945, 731–733, 5/512, 513, 946

See application file for complete search history.

(56) References Cited

U.S. PATENT DOCUMENTS

| | | | | |
|---|---|---|---|---|
| 5,455,973 | A * | 10/1995 | Brumfield et al. | 5/424 |
| 6,085,372 | A * | 7/2000 | James et al. | 5/713 |
| 6,154,900 | A * | 12/2000 | Shaw | 5/81.1 R |
| 6,393,639 | B1 * | 5/2002 | Ohsner | 5/425 |
| 6,739,001 | B2 * | 5/2004 | Flick et al. | 5/425 |
| 6,848,130 | B1 * | 2/2005 | Wilson | 5/425 |
| 7,155,766 | B1 * | 1/2007 | Gilchrest et al. | 5/732 |

* cited by examiner

*Primary Examiner*—Michael Trettel
(74) *Attorney, Agent, or Firm*—MacMillan, Sobanski & Todd, LLC

(57) ABSTRACT

A bolster for resisting rolling of a person off of a mattress, comprising a lateral cushion adapted to be disposed proximate and parallel to an edge of the mattress, and a tensile portion having a means for attachment to said lateral cushion, providing a distributed tensile force to resist a laterally outward displacement of the lateral cushion, the tensile force being transmitted beneath the mattress having a force vector downward and inward. Both the lateral cushion and the mattress may be inflatable, and preferably a pair of lateral cushions, interconnected by a tensile sheet below the mattress, are provided.

20 Claims, 4 Drawing Sheets

BOLSTER SYSTEM AND METHOD

RELATED APPLICATIONS

The present application is a continuation of U.S. patent application Ser. No. 11/002,604, filed Dec. 2, 2004, now U.S. Pat. No. 7,155,766, which is expressly incorporated herein by reference.

BACKGROUND OF THE INVENTION

1. Field of the Invention

The present invention relates to a bolster for an air mattress.

2. Description of Background Art

A number of types of air mattresses are known, including low air loss beds, lateral rotation beds and fluidized bead beds. See, e.g. U.S. Pat. Nos. 6,694,555, 6,536,056, and 6,353,950, expressly incorporated herein by reference in their entirety. One type of known design has a series of transversely oriented bladders disposed side-by-side to form a mattress. Each bladder has a port for inflation and rapid deflation, and typically has a series of punctures on the top to provide a low flow of air out of the bladder toward the person lying on the bed. A blower control is typically provided to inflate the mattress and heat the air, and a number of other functions may be provided as well. The blower control may have a number of zones, for example head, back, buttock, and leg. Each of these zones may have independent pressure control. In addition, the blower control may be integrated with the bed frame control, to adjust for inclination, sitting posture, etc. The blower control may also provide an auxiliary output, for example to provide lateral rotation.

Pneumatic bolsters are also known. See, e.g., U.S. Pat. No. 6,668,399, expressly incorporated herein by reference in its entirety. See also, U.S. Pat. Nos. 5,421,044; 5,956,787; 6,085,372; 6,065,166; 6,154,900; 6,782,574; 6,739,001, each of which is expressly incorporated herein by reference in its entirety.

SUMMARY OF THE INVENTION

The present invention provides a pneumatic bolster for an air mattress support, wherein the mattress comprises a plurality of adjacent bladder segments disposed transversely across the bed, the bolster having a tension web portion having a set of perforating apertures through which the transverse bladder segments are inserted, and a pneumatically inflated longitudinal bolster portion, at a lateral edge of the tension web, sitting on the upper surface of the mattress, adapted to impede rolling or sliding of an occupant of the bed. Typically, the bolster is bilaterally symmetric, and thus protects both lateral edges of the mattress, but need not be so. In a symmetric form, the two tension webs are interconnected at their bottom edges which lay under the mattress.

The bolster is compatible with various mattress designs, although the size and spacing of apertures typically must correspond to the mattress bladders. Because the purpose of the tension web is to position the bolster, other suitable positioning means may be employed. For example, instead of a sheet having a series of oval apertures, this portion may be configured as a set of straps between the bolster and lower restraining portion. Likewise, instead of apertures, the bolster may be positioned by a sheet having a series of pockets for enveloping the termini of the mattress bladders.

The lower edge of the tension web (or other positioning structures) is subjected to a transverse force, toward the centerline of the mattress. In a bilaterally symmetric embodiment, this force is conveniently provided by the interconnection of positioning structures with a tensile sheet, thus pulling each other.

The longitudinal bolster portions may be attached to straps at the edge of the mattress bladders, or the bed frame, by a set of straps spaced longitudinally at the lateral edge of the bolster cushion. Thus, the bolster is subjected to tensile forces from both sides; on a lateral side by tensile forces provided through straps or other connection system to the mattress straps or the bed frame; and medially by the tensile sheet or its functional equivalent. Typically, the bolster substitutes for the normally provided bed rails, and serves similar functions.

The tension web (or positioning structures) are subject to tensile forces exerted at different heights, i.e., above the mattress laterally, and below the mattress medially, so it will typically be inclined upward and outward, forming an open-top trapezoid. The apertures are oval or elliptical, to accommodate an oval or cylindrical mattress bladder segment. To place the bolster on a mattress, the bolster may be situated on the mattress while it is deflated and flexible, with the ends of the mattress bladders inserted through the apertures.

The bolster is typically inflated to a higher pressure than the bladders of the mattress, since it is intended, over a smaller surface area, to resist shifting of the occupant of the bed. It is, however, not inflated to such a high pressure that there would be injury risk if the occupant hit or bump into it. In fact, a particular advantage of the bolster over a bedrail is that it would tend to reduce in-bed injuries associated with bedrails, both from hitting into them and getting body parts caught when they are raised and lowered.

The bolster may be provided with ingress/egress regions which have a lower nominal height above the mattress. For example, this may be achieved by constricting the bolster bladder by forming a set of longitudinal seals between opposing sides of the bladder. These ingress/egress regions may extend over about the middle fifth of the bolster. Thus, an ambulatory occupant of the bed can sit up and extend his or her feet over the constricted portion, and then exit the bed, or enter the bed in corresponding manner, without deflating the bolster.

The preferred design also includes a vent valve, which allows a rapid deflation of the bolster, for example to allow repositioning of an immobile person out of the bed without sitting up or climbing over the bolster, or to provide unimpeded access in case of emergency.

Since the bolster is inflated to a generally higher pressure than the rest of the mattress, through a common blower, the valve may include a checkvalve function, to prevent backflow when, for example, an external pressure is applied to the bolster. The valve is typically designed to allow at least 50% reduction in superambient pressure of the bolster within about 3 seconds, to allow near immediate access in case of emergency. For example, if the bolster is inflated to 2 psia, it would drop to no more than 1 psia within 3 seconds. Of course, other deflation parameters may be employed.

The bolster may be provided with a separately valved zone on a blower system, thus eliminating the need for the separate manually actuable valve. In addition, the dump function of the valve may be electronically controlled by the blower control, to allow a single actuation of a "CPR" function to deflate the entire bed structure in case of emergency.

These and other objects, features, and advantages of the present invention will become evident to those skilled in the art in light of the following brief description of the drawings and detailed description.

DETAILED DESCRIPTION OF THE PREFERRED EMBODIMENTS

Figure 1:
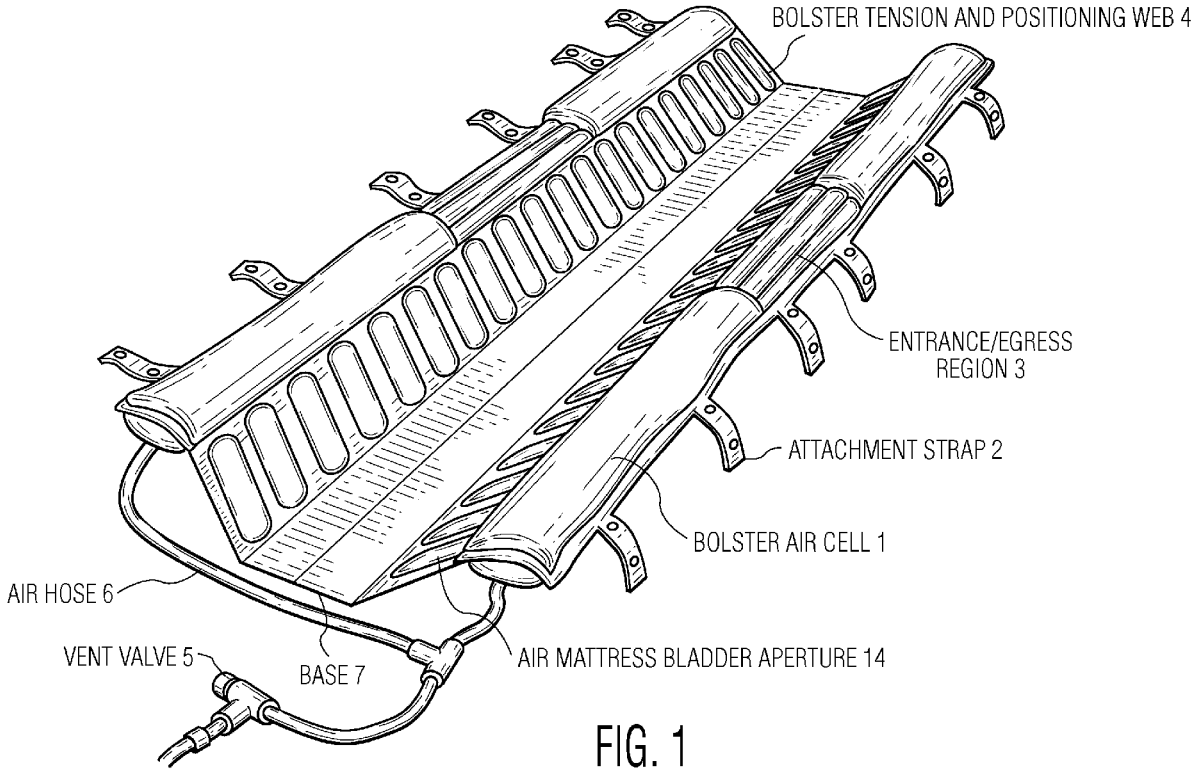
FIG. 1 shows a top perspective view of a bolster assembly in accordance with the present invention.

The mattress 10 comprises a plurality and inflatable tubular bladder elements 15 (or "cushions" or "air bags"). The individual cushion elements 15 may be arranged into a plurality of body support regions: e.g., the head region, the back region, the buttock region, and the leg/foot region. The mattress 10 is typically used for the reduction or relief of skin interface pressures for patient at risk of developing pressure ulcers or patients who already have pressure ulcers.

All air bladders, e.g., of both the mattress 10 and the bolster 1, in the preferred embodiment, comprise a polyurethane coated, impermeable, heavy duty fabric. The air bladder elements 15 of the mattress 10 preferably have a defined set of perforations, to permit a steady flow, relatively low flow of air through the fabric.

A control unit (or "controller") includes the components for inflating and controlling the mattress, and, in the case of a hospital bed, for interfacing with patient caregiver. As will be evident to those of ordinary skill in the art, such components (not shown) include a blower, a microprocessor or the equivalent, a heater, various valves and pressure sensors, manifolds, and connections, in such manner as may be desired. A separate valve and pressure sensor are provided for the bolster system. The controller has a housing adapted with adjustable hooks for mounting on the footboard or siderail of frame. The control unit connects to each one of cushions via a plurality of fluid lines (not shown) contained within a trunk line to supply the cushions with air as an inflating medium. A separate fluid line is provided for supplying the bolster with air. The fluid lines connect to their respective cushions using any suitable means such as a quick connect valve that includes a male member having a flange and a female member having a cavity about its inner surface for receiving the flange.

The controller comprises an operator input and display, processor unit, power supply, heater, temperature sensor and temperature control, blower and blower control, pressure sensors, and an air controller valve bank. The controller connects to any suitable power source such as a 120 VAC power line, preferably via a "hospital grade" outlet. The controller generates control signals for the air control valve bank to allow blower to inflate each of cushions and the bolster to appropriate pressures. The air control valve bank comprises, for example, 5 air control valves corresponding to the four zones of the mattress and the bolster. It may also comprise 4 controlled zones plus an uncontrolled output, for use in conjunction with a separate bolster valve system. While known blower controllers do not typically include a port for a bolster, they may include ports for bladders intended to position a patient along the sagittal, coronal, and or transverse planes. If available, one of these may be substituted, or an additional port provided specially for this purpose.

An integrated blower controller can be provided which not only controls the inflation of the air bolster 1, but also includes sensors and alarms to make sure a caregiver does not leave the bed in an unsafe state, i.e., bolsters uninflated and bed occupied. Other monitors and enunciators may also be provided, for example, to sense a disoriented patient trying to climb over the bolster, which would generally cause a pressure fluctuation.

Likewise, in a rapid inflate bolster configuration, the bolster may be relatively uninflated normally, and sense when the occupant is touching it or trying to roll or shift over it. In such cases, the bolster 1 could rapidly inflate, thus impeding the undesired activity, while leaving the occupant in a less confined environment otherwise. The sensor could be, for example, a pressure sensor or touch sensor on the bolster 1 bladder, or an optical interruption sensor along the length of the bolster 1.

A "CPR" button on the controller provides the user with the option of automatically and completely deflating each of mattress cushions 15 and bolster 1, and a deflate button for deflating the bolster 1 only. Alternately, the bolster 1 deflate function may be separate from the controller, by means of a valve which blocks flow of air from the controller and vents air in the bolster 1. It is also possible to control the left and right bolster bladders 1*a*, 1*b* separately, if desired. If the user presses CPR button, processor unit deactivates the blower and controls the air control valves in air control valve bank such to open the fluid lines to the atmosphere.

The side bolsters 1*a*, 1*b* according to the present invention are typically used to assist in the prevention of patients falling out of bed. The preferred embodiment of the present invention also has a mid-section entrance (ingress)/egress region 3 having a lower height that allows ingress-egress without deflating either of the side bolsters 1*a*, 1*b*. However, one or both of the bolsters 1 can also be deflated when performing nursing procedures or when the patient wishes to exit or enter the bed. The air bolsters 1 can be deflated for shipping and mattress storage.

Figure 4:
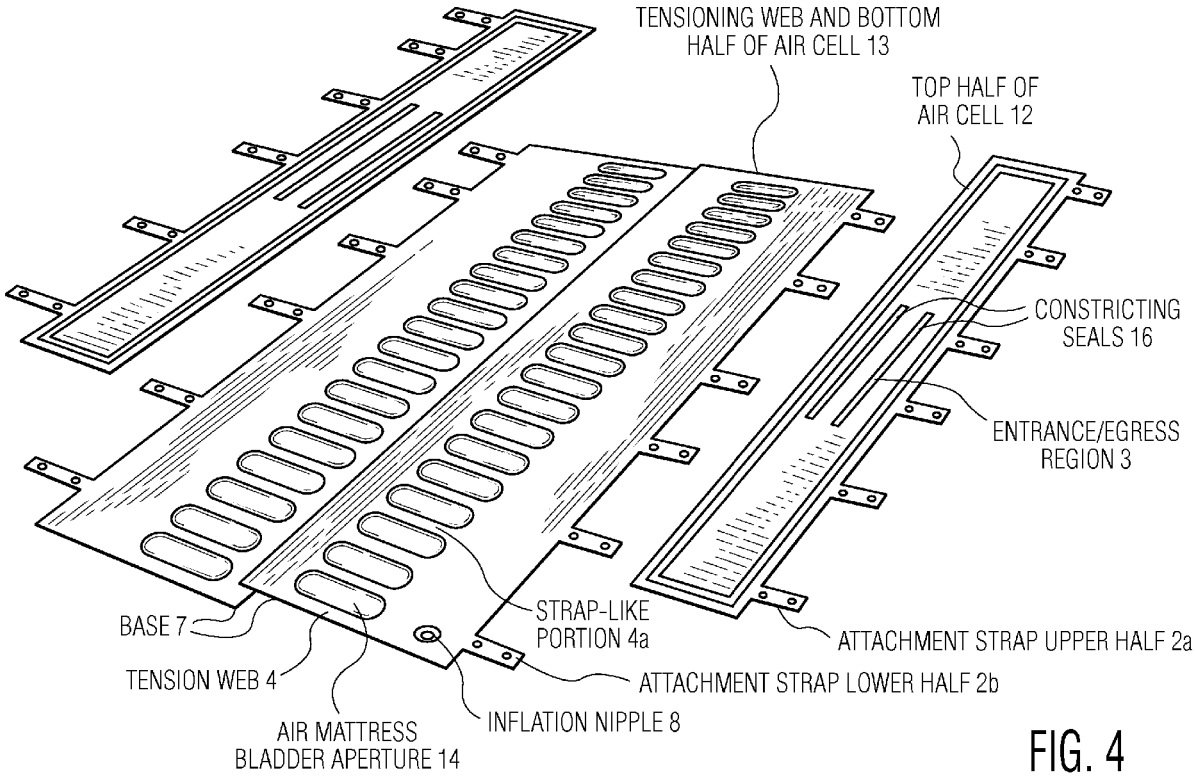
FIG. 4 shows an exploded view of the components of the bladder portion of the assembly.

As shown in FIG. 4, the bolster 1 is provided as a heat-sealed polyurethane-coated fabric pneumatic structure. The bolster bladders 1*a*, 1*b* are formed be sealing together a top half 12 and bottom half 13, to form a closed space there-between. At approximately the middle third or middle fifth of the bladder 1, the potential space may be constricted by additionally forming seals between the two sheets 12, 13, thus limiting their separation when inflated.

The bolster 1 as it is designed is manufactured by radio frequency (RF) welding sheets of urethane coated nylon fabric that have been previously die cut to the proper configuration. The material could also be nylon/vinyl, straight vinyl, or straight urethane among many other materials that are known in the art for creation of inflatables. The mattress 10 that it is used with is manufactured out of similar materials for its air cells, along with a number of other fabrics for the remainder (urethane/nylon top cover with a polyester filled quilted backing, and a 1680 denier nylon "tub" that contains the cells)

Advantageously, the top 12 and bottom 13 sheets have extensions 2*a*, 2*b* spaced along their length to form straps 2, which are provided with snaps or other attachment devices, which may include statistical hook and loop fasteners (e.g., Velcro®), magnets, hooks, or the like. These straps 2 are designed to encircle the straps 11 of the mattress, to hold the bolster 1 in place at its lateral edges.

The upper sheet 12 is shaped to provide the bolster bladder 1*a* or 1*b* and straps 2*a*. The lower sheet 13 also forms the bolster bladder 1*a* or 1*b*, and straps 2*b*, and additionally provides the tension web 4, and inflation nipple 8. The tension web 4, which in this design is contiguous with the lower sheet or base 7, but need not be, has a series of oval apertures 14 spaced and sized to accommodate the mattress bladders 15. Opposite the bolster bladder 1*a* or 1*b*, a tensile extension is provided, which may be sealed or snapped to the tension web 4 of the opposite bolster 1*b* or 1*a*, to complete the base 7. Alternately, the bolster 1 may be provided on a single side of the mattress 10, and thus may be attached to the bed frame along its midline (not shown).

As shown in FIG. 1, the interconnected tension webs 4 form a trapezoidal concave-upward structure, having a series of apertures 14, above which the bolster bladders 1*a*, 1*b* sit. FIG. 1 also shows the vent valve 5 and pneumatic conduit (air hose 6) to the bolster bladders 1*a*, 1*b*. The vent valve 5 permits a user to manually deflate the bolster bladders 1*a*, 1*b* and dump the air to the environment, without deactivating the blower. Thus, the bolster 1 assembly can be provided separately and independently from a blower, and may be retrofit onto existing beds. If the bolster bladders 1*a*, 1*b* are to be operated separately, the vent valve 5 would include a pair of controls for operating separate valve bodies.

Figure 2:
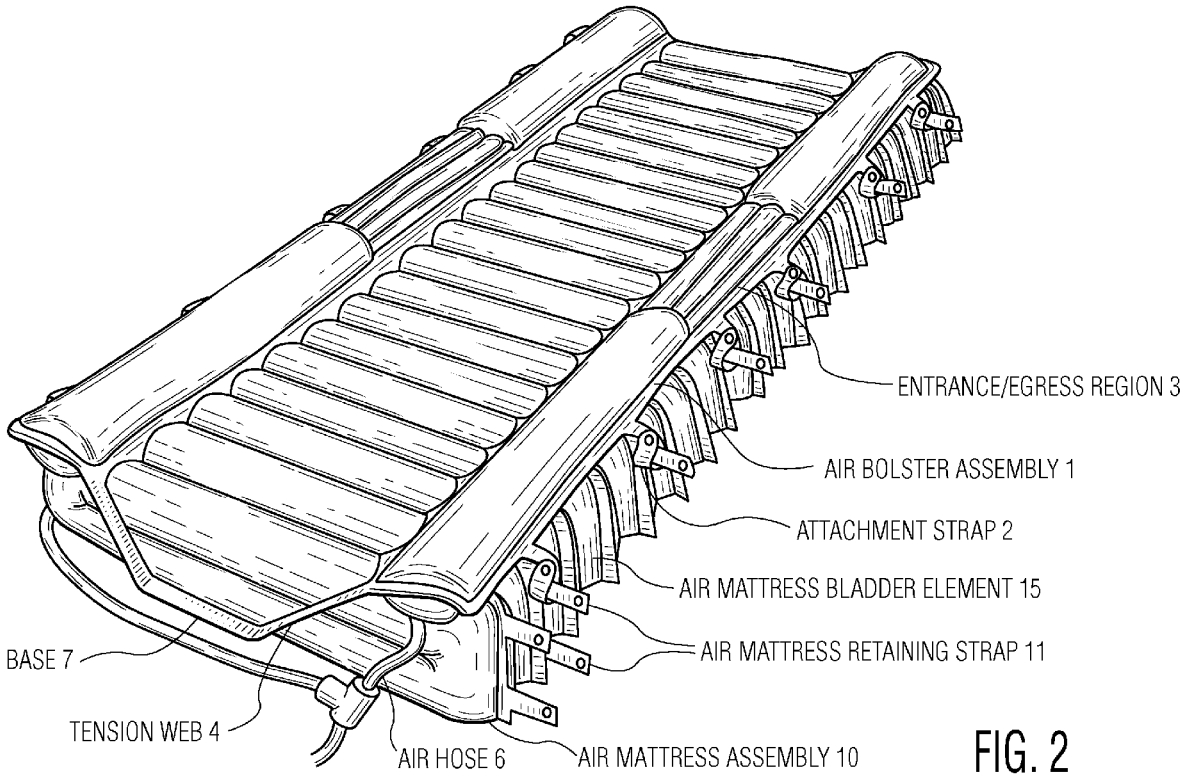
FIG. 2 shows a top perspective view of the bolster assembly of FIG. 1 installed on an air mattress.

FIG. 2 shows the bolster 1 assembly in place on an inflated air mattress 10. In this case, the air mattress 10 has bladders 15 which are taller than wide, due to a central seal in each segment. The tension web 4 provides a strap-like portion 4*a* which extends between each pair of adjacent segments 15. The straps 2 at the lateral edge of the bolster bladder 1*a*, 1*b* are wrapped around the straps 11 of the mattress bladders 15, which in turn are attached to the bed frame (not shown), and thus held in position laterally. As can be seen, the central constricted portion 16 at the entrance/egress portion 3 of the bolster 1 has a lower height than the unconstricted remaining portions, facilitating ingress and egress of a mobile occupant.

Figure 3:
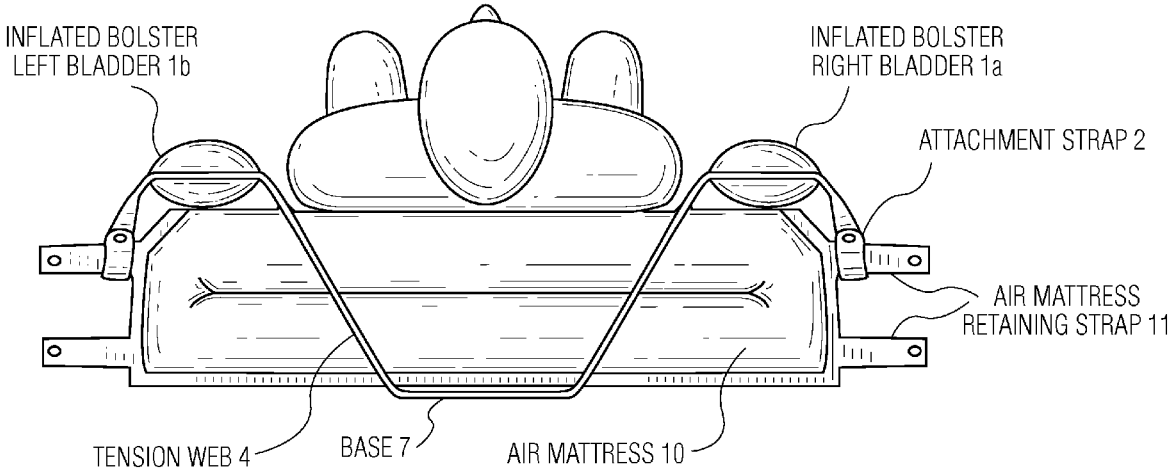
FIG. 3 shows an end view of the bolster and mattress of FIG. 2 with a person lying on the mattress.

FIG. 3 shows an occupant lying on the air mattress 10, with the bolsters 1 positioned to impede rolling and/or shifting. Since the bladder 1 structures are pneumatic, and inflated to a relatively low pressure, there is a low risk of injury if an occupant were to thrash or bump into the bolster 1, and the risk of entrapment or pinching of arms and legs in a falling bed rail is eliminated.

The bolster according to the present invention may also be used in a modified form for other types of mattresses and bolsters. For example, the pneumatic cushion may be replaced with a foam cushion, using the same attachment and positioning system, e.g., straps 2 and tension web 4, as described above. This attachment method gives strong lateral strength to the bolsters from moving on the bed without reducing an air mattress surface's pressure relief characteristics. Thus, the lateral tensile support for the bolster cushions is below the mattress, not above it, preventing a "hammocking" effect that reduces the advantages of an air mattress. That is, if the medial tensile member were provided above the mattress surface, it would produce relatively high forces against the skin of the occupant corresponding to the lateral force asserted against the bolster. This tends to reduce the advantageous independent and resilient effect of the individual mattress bladders.

Likewise, the air bolster system may be used on other types of mattresses, for example the tension web elements could periodically perforate through a foam mattress, allowing the bolsters to be laterally supported by a tension which is applied below the mattress cushion. (In order to allow installation, the strap-like portions would be separable, and for example, snap, hook or hook-and-loop fasten together.) Likewise, a foam mattress may be provided with snaps, hooks or hook-and-loop fasteners on its upper surface, displaced from the lateral edge, to allow positioning of the bolster with respect to the mattress. The lateral edge of the bolster could be attached directly to a bedframe, instead of the mattress, or to the lateral edge of the mattress. In order to reduce or balance the tensile forces on the surface of a mattress, while maintaining a sealed surface, the attachment points for the bolster may be reinforced from below with a tensile member, such as a strap or cable, internal to the mattress. Beneath the mattress, further attachment points may be provided to further transmit the forces, for example through straps to the rigid bed frame. Alternately, the tensile forces may be passed internal to the mattress, beneath the padding.

Although the present invention has been described in terms of the foregoing embodiment, such description has been for exemplary purposes only and, there will be apparent to those of ordinary skill in the art, many alternatives, equivalents, and variations of varying degrees that will fall within the scope of the present invention. That scope, accordingly, is not to be limited in any respect by the foregoing description, rather, it is defined only by the claims which follow.

What is claimed is:

1. A bolster for maintaining a human on a mattress, comprising:

a) a cushion adapted to be disposed proximate and parallel to a lateral edge of the mattress; and b) a tensile element for imparting an inward and downward oriented tension on said cushion, having a portion which extends under the mattress, wherein an occupant of the mattress exerts a downward force on said portion, which provides a component of said tension when the occupant rolls toward said cushion, to thereby resist rolling of the occupant of the mattress in dependence on a weight of the occupant.

2. The bolster according to claim 1, wherein said cushion is inflatable.

3. The bolster according to claim 1, wherein the mattress is inflatable.

4. The bolster according to claim 2, wherein the mattress is inflatable, said bolster and the mattress being adapted to be inflated by a common inflation device.

5. The bolster according to claim 1, wherein said tensile element comprises a web to provide a distributed force along said bolster.

6. The bolster according to claim 5, wherein said tensile elements comprises a series of spaced straps extending through the mattress medial to said lateral cushion.

7. The bolster according to claim 1, further comprising a second cushion, said cushion and said second cushion each disposed on respectively opposite lateral sides of the mattress, and wherein said tensile portion extends between said cushion and said second cushion.

8. The bolster according to claim 7, wherein said cushion, said second cushion, and said tensile element are configured to transmit a lateral force induced by an occupant of the mattress and a weight of the occupant of the mattress through said tensile element, under the mattress, and back up through the mattress to said second cushion.

9. The bolster according to claim 1, in combination with an inflatable mattress having a plurality of inflatable segments disposed extending transversely between respective lateral edges of said mattress, wherein said tensile element has spaced members which traverse a gap between respectively adjacent inflatable segments of said inflatable mattress.

10. The bolster according to claim 9, wherein said tensile element comprises a sheet having an array of apertures, said apertures being adapted to receive therethrough a respective inflatable segment of said inflatable mattress.

11. The bolster according to claim 1, wherein said cushion comprises a longitudinally central region having a reduced height with respect to respective head and foot regions thereof, adapted for facilitating ingress and egress of an occupant of the mattress onto and off of the mattress while sitting up, while maintaining an ability of said cushion to restrain the occupant of the mattress with respect to a rolling motion while laying down.

12. The bolster according to claim 1, wherein said cushion has a wall and is inflatable, having at least one first longitudinal region having an approximately cylindrical cross section and at least one second longitudinal region having a non-cylindrical cross section, said at least one second region having a non-cylindrical cross section comprises at least one internal tensile element attached between respectively opposite portions of said wall of said inflatable cushion, to pull an outer wall of said cushion inwardly at respective attachment points of said at least one internal tensile element.

13. The bolster according to claim 1, further comprising a second cushion, disposed at a laterally opposite side of the mattress from said cushion, said cushion and said second cushion each being inflatable; and an inflation control for independently controlling an inflation state of said cushion and said second cushion.

14. The bolster according to claim 2, further comprising a conduit for supplying a compressed gas to said cushion, and a valve for selectively releasing pressure within said inflatable cushion.

15. The bolster according to claim 1, wherein said cushion is formed by a process of sealing a plurality of sheets together in a pattern forming an inflatable potential space therebetween.

16. The bolster according to claim 10, wherein said apertures are oval.

17. The bolster according to claim 1, wherein said cushion is retained in position with respect to the mattress a lateral edge thereof by a plurality of straps.

18. The bolster according to claim 1, wherein at least one of said cushion and the mattress comprise a foam padding material.

19. A method for resisting a lateral rolling movement of an occupant of a mattress, comprising:

a) providing at least one cushion proximate and parallel to an edge of the mattress, the cushion having an upper edge extending substantially above a surface of the mattress and capable of applying sufficient force to support a substantial portion of the weight of the occupant above a surface of the mattress, to thereby impose a height barrier to rolling;

b) applying a medial and downward force to the cushion, directed below and through the mattress, the medial and downward force having a component which derives from a weight of the occupant, wherein a lateral displacement of the at least one cushion is resisted in part by a force which increases as a weight of the occupant increases.

20. The method according to claim 19, wherein the at least one cushion and the mattress are each inflatable, and are both adapted to be inflated by a common inflation device.

* * * * *

UNITED STATES PATENT AND TRADEMARK OFFICE

CERTIFICATE OF CORRECTION

PATENT NO. : 7,380,302 B2
APPLICATION NO. : 11/616266
DATED : June 3, 2008
INVENTOR(S) : Edward Gilchrest, Jr. and George E. Riehm It is certified that error appears in the above-identified patent and that said Letters Patent is hereby corrected as shown below:

Title Pg, Item (75), delete "Reihm" and insert --Riehm--

Signed and Sealed this

Twelfth Day of August, 2008

JON W. DUDAS
*Director of the United States Patent and Trademark Office*